United States Patent [19]

Igarashi et al.

[11] 4,168,223

[45] Sep. 18, 1979

[54] ELECTROPLATING BATH FOR DEPOSITING TIN OR TIN ALLOY WITH BRIGHTNESS

[75] Inventors: Shuji Igarashi; Yoshikazu Fujisawa; Toshio Igarashi, all of Tokyo, Japan

[73] Assignee: Dipsol Chemicals Co., Ltd., Tokyo, Japan

[21] Appl. No.: 960,944

[22] Filed: Nov. 15, 1978

[30] Foreign Application Priority Data

Nov. 16, 1977 [JP] Japan ..... 52-136730
Nov. 16, 1977 [JP] Japan ..... 52-136731

[51] Int. Cl.[2] ..... C25D 3/32; C25D 3/60

[52] U.S. Cl. ..... 204/43 S; 204/44; 204/54 R

[58] Field of Search ..... 204/43 S, 54 R, 54 L, 204/44, 120, 123; 106/1.25, 1.22

[56] References Cited

U.S. PATENT DOCUMENTS

| | | | |
|---|---|---|---|
| 3,616,306 | 10/1971 | Conoby et al. | 204/54 R |
| 3,769,182 | 10/1973 | Hsu | 204/43 S |
| 3,892,637 | 7/1975 | Polti | 204/43 S X |
| 3,905,878 | 9/1975 | Dohi et al. | 204/43 S |

FOREIGN PATENT DOCUMENTS

| | | | |
|---|---|---|---|
| 1469547 | 4/1977 | United Kingdom | 204/435 |

*Primary Examiner*—G. L. Kaplan
*Attorney, Agent, or Firm*—Birch, Stewart, Kolasch, and Birch

[57] ABSTRACT

An electroplating bath for depositing tin or a tin alloy with satisfactory brightness, which comprises a mother bath of a pH-value ranging from 4 to 8 and containing citric acid or its salt, an ammonium salt and a water-soluble polymer as a brightener. The bath may further comprise an aldehyde compound as a co-brightener.

8 Claims, No Drawings

ELECTROPLATING BATH FOR DEPOSITING TIN OR TIN ALLOY WITH BRIGHTNESS

The present invention relates to an electroplating bath for depositing tin or a tin alloy with brightness, and more particularly to such a bath containing citric acid or its salt and an ammonium salt.

The electrodeposition of tin or the tin alloy has widely been employed to protect steel or the like metal material from corrosion, or to give soldering ability to or improve the same of various materials.

For tin electroplating, hitherto, an acidic bath such as sulfuric acid bath or a basic bath such as sodium hydroxide bath has conventionally been employed. When the sulfuric acid bath is used, however, a homogeneous electrodeposition of tin can not be attained. In order to overcome this defect, a relatively large amount of surface active agent should be added in the bath but this causes bubbling in the bath so as to adversely affect on the plating efficiency and working environment. When the sodium hydroxide bath is used, the bath must be heated to about 70° C. to be similarly bubbled which causes the same defects. In this bath, further, the ionized tin in the bath is of tetravalency so that a higher current efficiency can not be attained.

For tin alloy electroplating, the bath containing sulfate, pyrophosphate, borofluoride, sodium stannate, alkali cyanide, gluconate or the like have been proposed. Among those, the sulfate, borofluoride and alkali cyanide baths require a special treatment for making same harmless, when discharged as waste liquid. The pyrophosphate, borofluoride, alkali cyanide and gluconate baths have a disadvantage that the composition of plated alloy is adversely varied in a relatively wide range due to fluctuation of current density during the electroplating. Further, borofluoride, alkali cyanide and sodium stannate baths do not show a desired high plating efficiency.

In order to overcome the disadvantages as referred to, a bath containing citric acid or its salt and an ammonium salt has been proposed (see, for instance, USSR Inventor's Certificate No. 293,876).

In the printed specification for said USSR Inventor's Certificate, there is a disclosure that dextrine and gelatine are added as brighteners to attain a finer and crystalline tin-zinc alloy deposition with a brightness. However, the "brightness" to be attained by this Inventor's Certificate process is of the degree "dull" or "mat" among the brightness degrees comprising bright (mirror bright), semi-bright, dull, mat and dendrite.

In order to improve the brightness, one of the present inventors has proposed together with others a brightener for tin-zinc alloy electroplatings, which is a water-soluble polymer obtained by reacting an aliphatic amine with an organic acid ester and then further reacting the reaction product with phthalic acid anhydride, or adding to the final reaction product an aromatic aldehyde as a co-brightener (Jap. Pat. Appln. No. 148 687/1974 which was early opened under the number of 75 632/1976). The brightener is advantageous in attaining a "bright" or "semi-bright" tin-zinc alloy electroplating regardless of a kind of the metal to be plated or an electroplating bath to be employed. The brightener, however, has a practical disadvantage that the range of working current density required during the electroplating is relatively narrow.

Therefore, a principal object of the present invention is to obviate and overcome the disadvantages referred to.

A specific object of the present invention is to provide an electroplating bath which contains citric acid or its salt and an ammonium salt and can commonly be employed for depositing tin and tin-alloys with satisfactory brightness.

Another specific object of the present invention is to provide an electroplating bath for tin and tin-alloys, which can be employed in a wide range of current density and more particularly is excellent in working efficiency at a higher current density.

A still other specific object of the present invention is to provide an electroplating bath for tin and tin-alloys, which, in case of the tin-alloy plating, provides a well plated coating having a substantially uniform composition, even if the current density fluctuates during the working.

According to the invention, the above objects and other objects to be appreciated by fully understanding the invention can be attained by adding to tin or tin-alloy mother bath of a pH value ranging from 4 to 8 which contains citric acid or its salt and an ammonium salt, a brightener comprising a water-soluble polymer selected from the group consisting of a polyoxyethylene, a derivative thereof and a reaction product of an epoxy compound with ethylene glycol, propylene glycol or glycerine.

In addition to the water soluble polymer, at least one aldehyde compound may be added as a co-brightener. As the aldehyde compounds, formaldehyde, acetaldehyde, propionaldehyde, glyoxal, succindialdehyde, caproaldehyde, aldol or the like aliphatic one and benzaldehyde, p-tolualdehyde, salicylaldehyde, veratraldehyde, anisaldehyde, piperonal, vanillin or the like aromatic one my be employed solely or as a mixture thereof. These aldehyde compounds themselves do not show any effect as the brightener when using either solely or in the form of a mixture thereof but serve to give a superior brightness to be classified as "bright" or "mirror bright" to the tin or tin-alloy electrodeposition when the same is used in combination with the water soluble polymer as main brightener. In this connection, please note that if no aldehyde compound is added to the electroplating bath, tin or tin-alloy film to be deposited on a base material assumes a brightness classified as "semi-bright" or "dull".

As the polyoxyethylenes and the derivatives thereof, there are compounds represented by the following formulae in which $n_1$, $n_2$ and $n_3$ are integrals showing polymerization degree ranging from 20 to 200, from 10 to 100 and from 5 to 50°, respectively.

$$HO\text{-}(CH_2\text{-}CH_2\text{-}O)_{n_1}\text{-}H \quad (1)$$

(2)

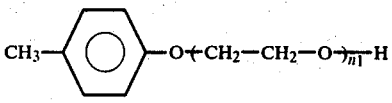

$$HO\text{-}(CH_2\text{-}CH_2\text{-}O)_{n_2}\text{-}(CH_2\text{-}\underset{\underset{CH_3}{|}}{CH}\text{-}O)_{n_2}\text{-}H \quad (3)$$

$$HO\text{-}CH_2\text{-}\underset{\underset{O\text{-}(CH_2\text{-}CH_2\text{-}O)_{n_1}\text{-}H}{|}}{CH}\text{-}CH_2\text{-}CH_2\text{-}OH \quad (4)$$

-continued

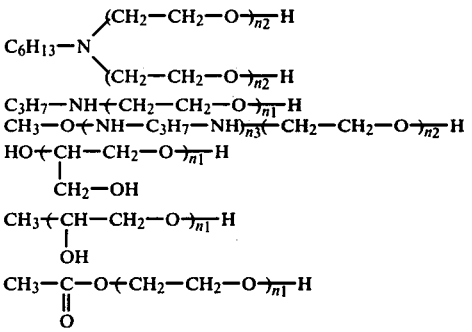

(5)

(6)

(7)

(8)

(9)

(10)

The polyoxyethylene or its derivative as the brightener is added to the mother bath in an amount of 1 to 5 g/l.

As the epoxy compounds, there are the compounds represented by following formulae wherein R represents a lower alkyl radical.

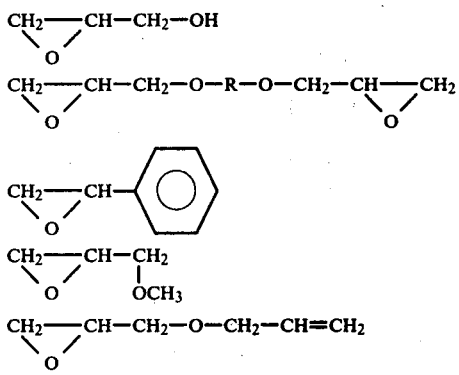

(1)

(2)

(3)

(4)

(5)

The reaction between the epoxy compound and ethylene glycol, propylene glycol or glycerine can be carried out by combining the both compounds and heating the mixture at a temperature of 30° to 120° C. under the atmospheric. The mol ratio between the epoxy compound and the other reactant depends on the number of epoxy radical in the former compound. In case mono-epoxy compound, ethylene glycol, propylene glycol or glycerine is employed in same mol amount with the epoxy compound but in case of di-epoxy compound, said other reactant is used in double mol amount. A catalyst of $BF_3$ or $SnCl_4$ may be employed to decrease the polymerization temperature or required reaction time period.

The reaction product as the brightener is added to the mother bath in an amount of 1 to 2 g/l.

The lower limits for the both type brighteners show an amount required for providing "dull brightness", respectively. The excessive addition of the brightener does not give any bad influence but is meaningless for improving the brightness.

The aldehyde compound as co-brightener is added to the mother bath in an amount of 0.1 to 0.5 g/l. The excessive addition does not give any bad influence but is meaningless.

It is preferable to carry out the electroplating at a bath temperature of 10° to 40° C. and current desity of 0.1 to 6 A/dm$^2$. When the plating be carried out outside said current density range, the deposited tin or tin-alloy will be sponge like or assume a dull or less brightness.

The invention will now be further explained in reference to examples.

EXAMPLES 1 TO 26

In each Example, any one of the following electroplatings was carried out.

| | |
|---|---|
| 1) Tin Plating | |
| Anode: Sn plate | |
| Composition of mother bath: | |
| $SnSO_4$ | 50 g/l |
| Ammonium citrate | 100 g/l |
| $(NH_4)_2SO_4$ | 80 g/l |
| 30% aqueous solution of ammonia | 50 g/l |
| pH of bath: 5.0 | |
| 2) Tin-Zinc Plating | |
| Anode: Sn—Zn (75:25) alloy plate | |
| Composition of mother bath: | |
| $SnSO_4$ | 38 g/l |
| $ZnSO_4$ | 36 g/l |
| Citric acid | 110 g/l |
| $(NH_4)_2SO_4$ | 70 g/l |
| 30% aqueous solution of ammonia | 80 g/l |
| pH of bath: 6.0 | |
| 3) Tin-Lead Plating | |
| Anode: Sn—Pb (65:35) alloy plate | |
| Composition of mother bath: | |
| $Sn(OOCCH_3)_2$ | 33 g/l |
| $Pb(OOCCH_3)_2$ | 15 g/l |
| $NH_4(OOCCH_3)_2$ | 50 g/l |
| 30% aqueous solution of ammonia | 50 g/l |
| pH of bath: 6.0 | |
| 4) Tin-Cobalt Plating | |
| Anode: Sn—Co (70:30) alloy plate | |
| Composition of mother bath: | |
| $SnSO_4$ | 26 g/l |
| $CoSO_4 \cdot 7H_2O$ | 30 g/l |
| Citric acid | 100 g/l |
| $(NH_4)_2SO_4$ | 70 g/l |
| pH of bath: 6.0 | |
| 5) Tin-Silver Plating | |
| Anode: Sn—Ag (80:20) alloy plate | |
| Composition of mother bath: | |
| $SnSO_4$ | 36 g/l |
| $Ag(OOCCH_3)_2$ | 10 g/l |
| Ammonium citrate | 90 g/l |
| $NH_4(OOCCH_3)_2$ | 40 g/l |
| 30% aqueous solution of ammonia | 40 g/l |
| pH of bath: 5.5 | |
| 6) Tin-Copper Plating | |
| Anode: Sn—Cu (70:30) alloy plate | |
| Composition of mother bath: | |
| $SnSO_4$ | 22 g/l |
| $CuSO_4$ | 25 g/l |
| Ammonium citrate | 100 g/l |
| $(NH_4)_2SO_4$ | 80 g/l |
| 30% aqueous solution of ammonia | 75 g/l |
| pH of bath: 6.2 | |

Other tems for carrying out the electroplatings were as follows.

Current charged: 1 A

Current charging time period: 10 min.

Electroplating temperature: 25°±1° C.

Cathode: degreased and cleaned Fe plate (6.5×10×0.3 cm)

Size of Anode: 6.5×6.0×0.5 cm

In Examples 15 to 26, the used brightener is designated by symbols EP-1 to 8 which were prepared by the processes shown below.

(1) EP-1

A water-soluble polymer synthesized by heating the following compounds at 60° C. in the presence of $BF_3$ as catalyst.

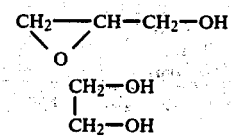

mol ratio, 1:1

(2) EP-2

A water-soluble polymer synthesized by heating the following compounds at 80° C. in the presence of $BF_3$ as catalyst.

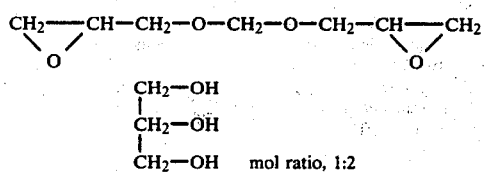

mol ratio, 1:2

(3) EP-3

A water-soluble polymer synthesized by heating the following compounds at 60° C. in the presence of $BF_3$ as catalyst.

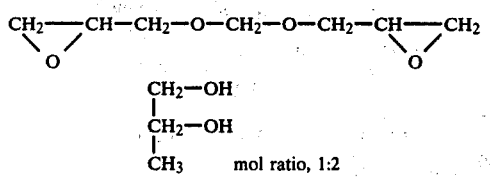

mol ratio, 1:2

(4) EP-4

A water-soluble polymer synthesized by heating the following compounds at 80° C. in the presence of $BF_3$ as catalyst.

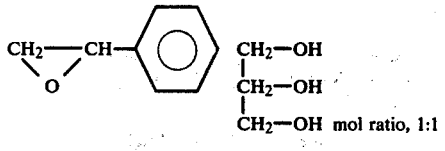

mol ratio, 1:1

(5) EP-5

A water-soluble polymer synthesized by heating the following compounds at 90° C. in the presence of $BF_3$ as catalyst.

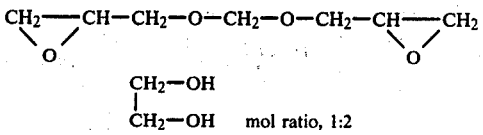

mol ratio, 1:2

(6) EP-6

A water-soluble polymer synthesized by heating the following compounds at 60° C. in the presence of $BF_3$ as catalyst.

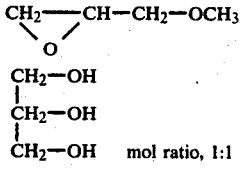

mol ratio, 1:1

(7) EP-7

A waater-soluble polymer synthesized by heating the following compounds at 80° C. in the presence of $BF_3$ as catalyst.

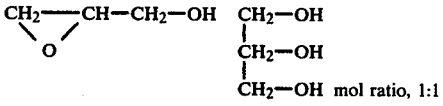

mol ratio, 1:1

(8) EP-8

A water-soluble polymer synthesized by heating the following compounds at 90° C. in the presence of $SnCl_4$ as catalyst.

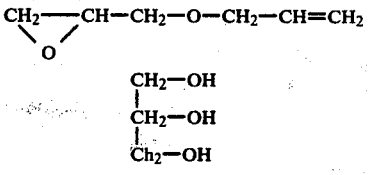

mol ratio, 1:1

Results are shown in the following Table.

| Example No. | Mother Bath | Brightener | Aldehyde Compound | Current Density (A/dm) | Brightness |
|---|---|---|---|---|---|
| 1. | tin plating bath | $HO-(CH_2-CH_2-O)_n-H$ | veratraldehyde (0.5 g/l) | 0.1–2 | bright |
| | | n = 100 | glyoxal (0.1 g/l) | 0.1–2 | bright |
| | | 5 g/l | none | 0.1–2 | semi-bright |
| 2. | tin plating bath | $HO-(CH_2-CH_2-O)_{n1}-(CH_2-CH(CH_3)-O)_{n2}-H$ | anisaldehyde (0.2 g/l) | 0.5–4 | bright |
| | | $n_1 = 20$, $n_2 = 50$ | formaldehyde (0.1 g/l) | 0.5–4 | bright |
| | | 2 g/l | none | 0.5–4 | semi-bright |
| 3. | tin-zinc plating bath | $HO-(CH_2-CH_2-O)_n-H$ | benzaldehyde (0.2 g/l) | 0.1–1 | bright |
| | | n = 100 | p-tolualdehyde (0.1 g/l) | 0.1–1 | semi-bright |
| | | 5 g/l | none | 0.1–1 | dull |

-continued

| Example No. | Mother Bath | Brightener | Aldehyde Compound | Current Density (A/dm) | Brightness |
|---|---|---|---|---|---|
| 4. | tin-zinc plating bath | 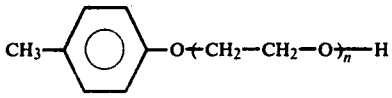 | veratraldehyde (0.5 g/l) | 0.2–2 | semi-bright |
| | | n = 100<br>2 g/l | piperonal (0.5 g/l) | 0.2–2 | semi-bright |
| | | | none | 0.2–2 | dull |
| 5. | tin plating bath | $HO-CH_2-\underset{\underset{O\leftarrow CH_2-CH_2-O\rightarrow_n-H}{\vert}}{CH}-CH_2-CH_2-OH$ | glyoxal (0.1 g/l) | 0.5–4 | bright |
| | | | aldol (0.1 g/l) | | |
| | | n = 100<br>2 g/l | salicylaldehyde (0.1 g/l) | 0.2–2 | bright |
| | | | none | 0.5–4 | semi-bright |
| 6. | tin-zinc plating bath | $C_6H_{13}-N(CH_2-CH_2-O\rightarrow_n-H)_2$ | acetaldehyde (0.1 g/l) | 0.1–2 | semi-bright |
| | | | piperonal (0.5 g/l) | 0.1–2 | bright |
| | | n = 50<br>2 g/l | none | 0.1–2 | dull |
| | | $C_3H_7-NH\leftarrow CH_2-CH_2-O\rightarrow_n H$ | veratraldehyde (0.5 g/l) | 0.1–2 | bright |
| 7. | tin-zinc plating bath | n = 150<br>2 g/l | vanillin (0.1 g/l) | 0.1–2 | semi-bright |
| | | | propionaldehyde (0.1 g/l) | | |
| | | | none | 0.1–2 | dull |
| | | | aldol (0.5 g/l) | 0.1–0.5 | bright |
| | | $CH_3-O\leftarrow NH-C_3H_7-NH\rightarrow_{n1}(CH_2-CH_2-O\rightarrow_{n2}-H$ | glyoxal (0.2 g/l) | | |
| 8. | tin-lead plating bath | $n_1 = 50$<br>$n_2 = 50$<br>2 g/l | succin-dialdehyde (0.1 g/l) | 0.1–0.5 | semi-bright |
| | | | none | 0.1–0.5 | dull |
| | | $HO\leftarrow\underset{\underset{CH_2-OH}{\vert}}{CH}-CH_2-O\rightarrow_n-H$ | piperonal (0.8 g/l) | 1–4 | bright |
| | | | glyoxal (0.2 g/l) | | |
| 9. | tin-cobalt plating bath | n = 100<br>2 g/l | none | 1–4 | semi-bright |
| | | $CH_3\leftarrow\underset{\underset{OH}{\vert}}{CH}-CH_2-O\rightarrow_n-H$ | veratraldehyde (0.5 g/l) | 0.2–3 | bright |
| 10. | tin-zinc plating bath | | anisaldehyde (0.1 g/l) | 0.2–3 | bright |
| | | n = 100<br>2 g/l | none | 0.2–3 | semi-bright |
| | | $CH_3-\underset{\underset{O}{\Vert}}{C}-O\leftarrow CH_2-CH_2-O\rightarrow_n-H$ | glyoxal (0.2 g/l) | 0.1–2 | semi-bright |
| 11. | tin plating bath | | caproaldehyde (0.5 g/l) | 0.1–0.5 | semi-bright |
| | | n = 100<br>2 g/l | none | 0.2–3 | dull |
| | | $C_3H_7-NH\leftarrow CH_2-CH_2-O\rightarrow_n-H$ | veratraldehyde (0.5 g/l) | 0.2–3 | bright |
| | | n = 150<br>1 g/l | veratraldehyde (0.2 g/l) | 0.2–3 | bright |
| 12. | tin-zinc plating bath | $CH_3\leftarrow\underset{\underset{OH}{\vert}}{CH}-CH_2-O\rightarrow_n-H$ | anisaldehyde (0.2 g/l) | | |
| | | n = 100<br>1 g/l | none | 0.2–3 | semi-bright |
| | | $HO\leftarrow CH_2-CH_2-O\rightarrow_n-H$ | piperonal (0.2 g/l) | 0.1–2 | bright |
| | | n = 100<br>1 g/l | | | |
| 13. | tin-cobalt plating bath | $HO\leftarrow\underset{\underset{CH_2-OH}{\vert}}{CH}-CH_2-O\rightarrow_n-H$ | p-tolualdehyde (0.1 g/l) | 0.1–2 | bright |
| | | n = 100 | | | |

-continued

| Example No. | Mother Bath | Brightener | Aldehyde Compound | Current Density (A/dm) | Brightness |
|---|---|---|---|---|---|
| | | 1 g/l | none | 0.1–2 | semi-bright |
| | | $HO(CH_2-CH_2-O)_{n1}(CH_2-CH_2-O)_{n2}H$ | aldol (0.5 g/l) | 0.1–0.5 | bright |
| 14. | tin-lead plating bath | $n_1 = 20$, $n_2 = 50$, 1 g/l | formaldehyde (0.2 g/l) | 0.1–2 | semi-bright |
| | | $HO-CH_2-CH(O(CH_2-CH_2-O)_nH)-CH_2-CH_2-OH$, n = 100, 1 g/l | none | 0.1–2 | dull |
| | | | aldol (0.2 g/1) | 0.2–2 | bright |
| 15. | tin plating bath | EP-1 1 g/l | anisaldehyde (0.2 g/l) | 0.2–2 | bright |
| | | | none | 0.1–2 | semi-bright |
| | | | veratraldehyde (0.5 g/l) | 0.1–2 | bright |
| 16. | tin plating bath | EP-2 2 g/l | acetaldehyde (0.1 g/l) | 0.2–2 | bright |
| | | | none | 0.2–2 | semi-bright |
| | | | piperonal (0.1 g/l) | 0.2–2 | bright |
| 17. | tin-zinc plating bath | EP-3 2 g/l | p-tolualdehyde (0.1 g/l) | 0.1–2 | bright |
| | | | none | 0.2–2 | semi-bright |
| 18. | tin-zinc plating bath | EP-4 1 g/l | anisaldehyde (0.2 g/l) glyoxal (0.1 g/l) | 0.5–4 | bright |
| | | | salicylaldehyde (0.5 g/l) | 0.2–4 | bright |
| | | | none | 0.5–4 | semi-bright |
| | | | benzaldehyde (0.2 g/l) benzaldehyde (0.1 g/l) | 0.2–4 | bright |
| 19. | tin-silver plating bath | EP-5 1 g/l | formaldehyde (0.1 g/l) | 0.5–4 | bright |
| | | | none | 0.2–4 | semi-bright |
| | | | glyoxal (0.2 g/l) glyoxal (0.1 g/l) | 0.1–2 | bright |
| 20. | tin-zinc plating bath | EP-6 2 g/l | succindialdehyde (0.1 g/l) | 0.1–2 | semi-bright |
| | | | none | 0.1–2 | dull |
| | | | veratraldehyde (0.5 g/l) | 0.2–4 | semi-bright |
| 21. | tin-cobalt plating bath | EP-7 2 g/l (0.1 g/l) | formaldehyde | 0.5–4 | bright |
| | | | none | 0.2–4 | dull |
| | | | glyoxal (0.2 g/l) | 0.2–2 | bright |
| 22. | tin-lead plating bath | EP-8 2 g/l | formaldehyde (0.2 g/l) | 0.2–2 | bright |
| | | | none | 0.2–2 | dull |
| | | | piperonal (0.5 g/l) | 0.2–2 | bright |
| 23. | tin-zinc plating bath | EP-1 1 g/l EP-3 1 g/l | anisaldehyde (0.2 g/l) glyoxal (0.1 g/l) | 0.1–2 | bright |
| | | | none | 0.2–2 | semi-bright |
| | | | veratraldehyde (0.5 g/l) | 0.2–4 | bright |
| 24. | tin-zinc plating bath | EP-2 1 g/l EP-5 1 g/l | acetaldehyde (0.1 g/l) piperonal (0.1 g/l) | 0.1–2 | bright |
| | | | none | 0.2–4 | semi-bright |
| | | | anisaldehyde (0.2 g/l) aldol (0.2 g/l) | 0.2–1 | semi-bright |
| 25. | tin-copper plating bath | EP-6 1 g/l EP-7 1 g/l | propionaldehyde (0.1 g/l) | 0.2–1 | semi-bright |
| | | | none | 0.2–1 | dull |

-continued

| Example No. | Mother Bath | Brightener | Aldehyde Compound | Current Density (A/dm) | Brightness |
|---|---|---|---|---|---|
| | | | anisaldehyde (0.2 g/l) | 0.5–4 | bright |
| 26. | tin-zinc | EP-4 1 g/l | glyoxal (0.1 g/l) | | |
| | plating bath | EP-8 1 g/l | salicylaldehyde (0.1 g/l) | 0.5–4 | bright |
| | | | none | 0.5–4 | semi-bright |

We claim:

1. An electroplating bath for depositing tin or a tin-alloy with brightness, characterized by adding to a tin or tin-alloy mother bath of a pH-value ranging from 4 to 8, which contains citric acid or its salt and an ammonium salt, a brightener comprising a water-soluble polymer selected from the group consisting of a polyoxyethylene, a derivative thereof and a reaction product of an epoxy compound with ethylene glycol, propylene glycol or glycerine.

2. An electroplating bath as claimed in claim 1, further comprising an aldehyde compound as a co-brightener.

3. An electroplating bath as claimed in claim 2, wherein the aldehyde compound is at least one selected from the group consisting of formaldehyde, acetaldehyde, propionaldehyde, glyoxal, succindialdehyde, caproaldehyde, aldol, benzaldehyde, p-tolualdehyde, salicylaldehyde, veratraldehyde, anisaldehyde, piperonal and vanillin.

4. An electroplating bath as claimed in claim 3, wherein the aldehyde compound as co-brightener is added to the mother bath in an amount of 0.1 to 0.5 g/l.

5. An electroplating bath as claimed in claim 1, wherein the polyoxyethylene or the derivative thereof is at least one compound selected from the group consisting of

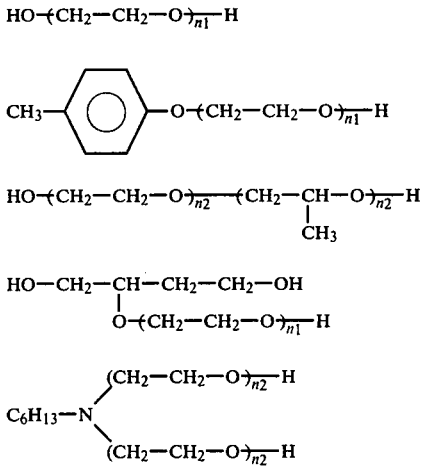

(1)

(2)

(3)

(4)

(5)

-continued

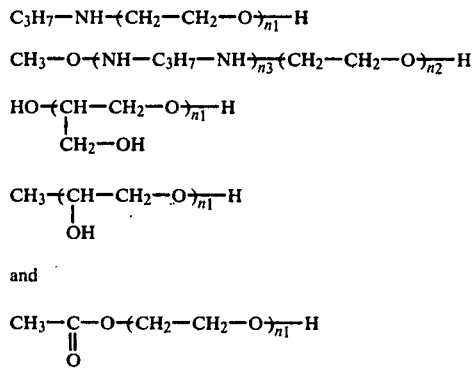

(6)

(7)

(8)

(9)

and (10)

wherein $n_1$, $n_2$ and $n_3$ are integrals showing polymerization degree ranging from 20 to 200, from 10 to 100 and from 5 to 50, respectively.

6. An electroplating bath as claimed in claim 5, wherein the polyoxyethylene or its derivative is added to the mother bath in an amount of 1 to 5 g/l.

7. An electroplating bath as claimed in claim 1, wherein the epoxy compound is at least one selected from the group consisting of

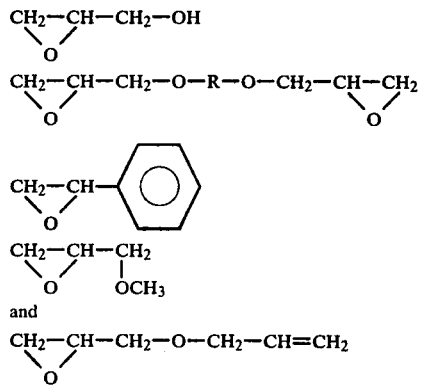

(1)

(2)

(3)

(4)

and (5)

wherein R is a lower alkyl radical.

8. An electroplating bath as claimed in claim 1, wherein the reaction product of the epoxy compound with ethylene glycol, propylene glycol or glycerine is added to the mother bath in an amount of 1 to 2 g/l.

* * * * *